US006584698B1

(12) United States Patent
Liu

(10) Patent No.: US 6,584,698 B1
(45) Date of Patent: Jul. 1, 2003

(54) ANGLE INDICATING APPARATUS CAPABLE OF POSITIONING AT PREDETERMINED ANGLES

(75) Inventor: Ta-Chang Liu, Taichung (TW)

(73) Assignee: P & F Brother Industrial Corporation, Taichung (TW)

( * ) Notice: Subject to any disclaimer, the term of this patent is extended or adjusted under 35 U.S.C. 154(b) by 0 days.

(21) Appl. No.: 10/209,250

(22) Filed: Jul. 30, 2002

(51) Int. Cl.[7] ..... B43L 7/10; B26D 7/06; B27B 27/04

(52) U.S. Cl. ..... 33/640; 33/468; 33/469; 33/471; 83/435.14; 83/477.2

(58) Field of Search ..... 33/424, 425, 426, 33/640, 465, 468, 469, 471, 479, 480, 421; 83/435.14, 477.2

(56) References Cited

U.S. PATENT DOCUMENTS

| | | | | | |
|---|---|---|---|---|---|
| 817,991 | A | * | 4/1906 | Ross | 33/469 |
| 845,009 | A | * | 2/1907 | Novak | 33/469 |
| 1,985,614 | A | * | 12/1934 | Merrigan | 33/500 |
| 2,435,529 | A | * | 2/1948 | Brockley | 33/468 |
| 3,903,600 | A | * | 9/1975 | Dalton | 30/376 |
| 4,741,387 | A | * | 5/1988 | Strong | 83/421 |
| 5,020,233 | A | * | 6/1991 | Syken | 33/465 |
| 5,038,486 | A | * | 8/1991 | Ducate, Sr. | 33/471 |
| 5,097,601 | A | * | 3/1992 | Pollak et al. | 33/471 |
| 5,187,877 | A | * | 2/1993 | Jory et al. | 33/640 |
| D400,452 | S | * | 11/1998 | Schoene et al. | D10/65 |
| 5,845,410 | A | * | 12/1998 | Boker | 33/469 |
| 5,915,806 | A | * | 6/1999 | Levee | 33/468 |
| 6,141,882 | A | * | 11/2000 | Syken | 33/471 |
| 6,195,905 | B1 | * | 3/2001 | Cole | 33/640 |
| 2002/0104417 | A1 | * | 8/2002 | Chen | 83/435.14 |
| 2003/0015078 | A1 | * | 1/2003 | Taylor | 83/437.2 |

* cited by examiner

*Primary Examiner*—Diego Gutierrez
*Assistant Examiner*—Madeline Gonzalez
(74) *Attorney, Agent, or Firm*—Merchant & Gould P.C.

(57) ABSTRACT

An angle indicating apparatus includes a rod member, an indicia member, an indicator, a spring-loaded tumbler unit, and a locking unit. The indicia member is mounted pivotally on the rod member about a pivot axis, and includes a base plate formed with a generally semi-circular cutout. The indicator is disposed in the cutout and points to angle indicia that are provided on the base plate adjacent to the cutout. The base plate is further formed with a curved guide slot, and has a bottom side formed with a plurality of angularly spaced apart positioning grooves. The spring-loaded tumbler unit is mounted on the rod member and engages removably a selected one of the positioning grooves. The locking unit passes through the guide slot and is operable so as to engage the rod member and arrest undesired rotation of the indicia member relative to the rod member.

7 Claims, 9 Drawing Sheets

ANGLE INDICATING APPARATUS CAPABLE OF POSITIONING AT PREDETERMINED ANGLES

BACKGROUND OF THE INVENTION

1. Field of the Invention

The invention relates to an angle indicating apparatus, more particularly to an angle indicating apparatus for use with a table saw and capable of positioning at predetermined angles.

2. Description of the Related Art

When cutting a work piece using a table saw, an angle indicating apparatus is employed to indicate the cutting angle and to position the work piece on the table saw.

Referring to FIG. 1, a conventional angle indicating apparatus 10 is shown to include a rod member 12, an indicia member 11, an indicator 13, and a locking unit 14.

The rod member 12 is slidably received in a slide groove of a table saw (not shown) such that the angle indicating apparatus 10 can be positioned on and is slidable relative to the table saw.

The indicia member 11 is mounted pivotally on the rod member 12 about a pivot axis, and includes a base plate 112 and a stop block 111 extending uprightly from one end of the base plate 112. The stop block 111 is used to abut against the work piece to be cut by the table saw. The base plate 112 is formed with a curved guide slot 113 having a curvature centered at the pivot axis. The base plate 112 further has a top side provided with angle indicia 114 that are disposed radially and outwardly of the guide slot 113 with respect to the pivot axis.

The indicator 13 is mounted on one end of the rod member 12, and has a pointing end 131 pointing to the angle indicia 114.

The locking unit 14 includes a handle body 141 and a threaded shank (not visible) extending from the handle body 141 and through the guide slot 113 so as to threadedly engage the rod member 12 and arrest undesired rotation of the indicia member 11 relative to the rod member 12.

In the conventional angle indicating apparatus 10, the indicia member 11 is allowed to rotate to any arbitrary angle due to the lack of a positioning mechanism. Therefore, when aligning the indicator 13 with a particular angle on the angle indicia 114, a few more micro-tuning steps are needed for final angle positioning. As such, the angle positioning procedure in the conventional angle indicating apparatus 10 is slow and troublesome. In view of the fact that a work piece is generally required to be cut at some standard angle, such as 30, 45 and 60 degrees, there is evidently a need for a simple angle positioning procedure.

To overcome the aforesaid drawback, another conventional angle indicating apparatus 20 has been proposed heretofore, as shown in FIG. 2. The conventional angle indicating apparatus 20 includes a rod member 22 and an indicia member 21. The indicia member 21 has angle indicia 211 and a plurality of protruding blocks 23 that extend from a periphery of the indicia member 21 and that are angularly spaced apart at predetermined angles. Each protruding block 23 has a positioning screw 231 mounted thereon. An indicator 24 is mounted on one end of the rod member 22, and has a pointing end pointing to the angle indicia 211. A stop plate 25 is mounted pivotally on one side of the indicator 24. The stop plate 25 is used to abut against one of the positioning screws 231 so as to quickly position the indicia member 21 at one of predetermined angles relative to the rod member 22. To move the indicia member 21 to another one of the predetermined angles, the stop plate 25 is pivoted to allow the adjacent protruding block 23 to pass through the indicator 24. After rotating the indicia member 21 to the desired one of the predetermined angles, the stop plate 25 is again pivoted to abut against the adjacent positioning screw 231. At this time, the locking unit 26 can be operated so as to threadedly engage the rod member 22 and arrest undesired rotation of the indicia member 21 relative the rod member 22.

Although the aforesaid angle indicating apparatus 20 provides the function of positioning the indicia member 21 at predetermined angles, the following drawbacks are encountered:

1) The pivoting operations of the stop plate 25 are awkward to conduct. Also, since the protruding blocks 23 with the positioning screws 231 mounted thereon take up a lot of space, the number of the protruding blocks 23 that can be installed is severely limited, thereby limiting the corresponding number of the predetermined angles.
2) The abutting force applied to the positioning screws 231 by the stop block 25 will result in angular misalignment in the long run. Therefore, the positioning screws 231 need to be periodically adjusted to ensure accuracy.
3) Because the indicator 24 and the protruding blocks 23 are disposed on the outer periphery of the indicia member 21, not only will there be inconvenience during operation, the user will also be prone to injury due to the sharp edges of the aforesaid components.

SUMMARY OF THE INVENTION

Therefore, the main object of the present invention is to provide an angle indicating apparatus that can overcome the aforesaid drawbacks of the prior art.

Accordingly, the angle indicating apparatus of the present invention includes a rod member, an indicia member, an indicator, a spring-loaded tumbler unit, and a locking unit.

The indicia member is mounted pivotally on the rod member about a pivot axis, and includes a base plate and a stop block extending uprightly from one end of the base plate. The base plate is formed with a generally semicircular cutout having a straight edge that is proximate to said one end of the base plate, and a curved edge that is connected to the straight edge and that has a curvature centered at the pivot axis. The base plate has a top side provided with angle indicia that are disposed adjacent to the curved edge of the cutout. The base plate is further formed with a curved guide slot that is disposed radially and outwardly of the curved edge of the cutout with respect to the pivot axis. The base plate further has a bottom side disposed on top of the rod member and formed with a plurality of angularly spaced apart positioning grooves. The positioning grooves correspond respectively to the predetermined angles and are spaced apart at equal radial distances from the pivot axis.

The indicator is mounted on the rod member, is disposed in the cutout, and has a pointing end pointing to the angle indicia.

The spring-loaded tumbler unit is mounted on the rod member and engages removably a selected one of the positioning grooves in the bottom side of the base plate.

The locking unit passes through the guide slot and is operable so as to engage the rod member in order to arrest undesired rotation of the indicia member relative to the rod member.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
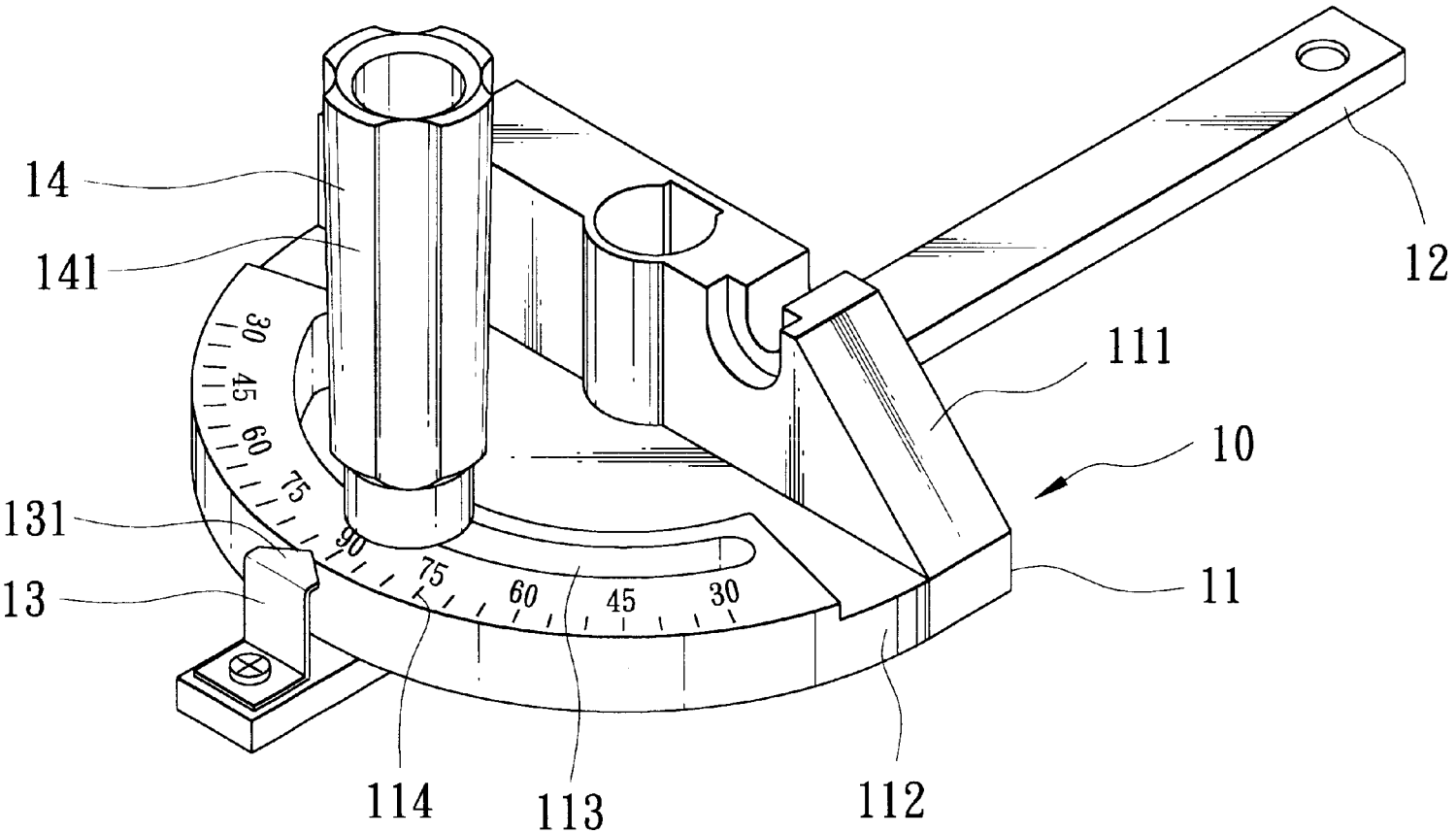
FIG. 1 PRIOR ART
FIG. 1 is an assembled perspective view of a conventional angle indicating apparatus.
Figure 2:
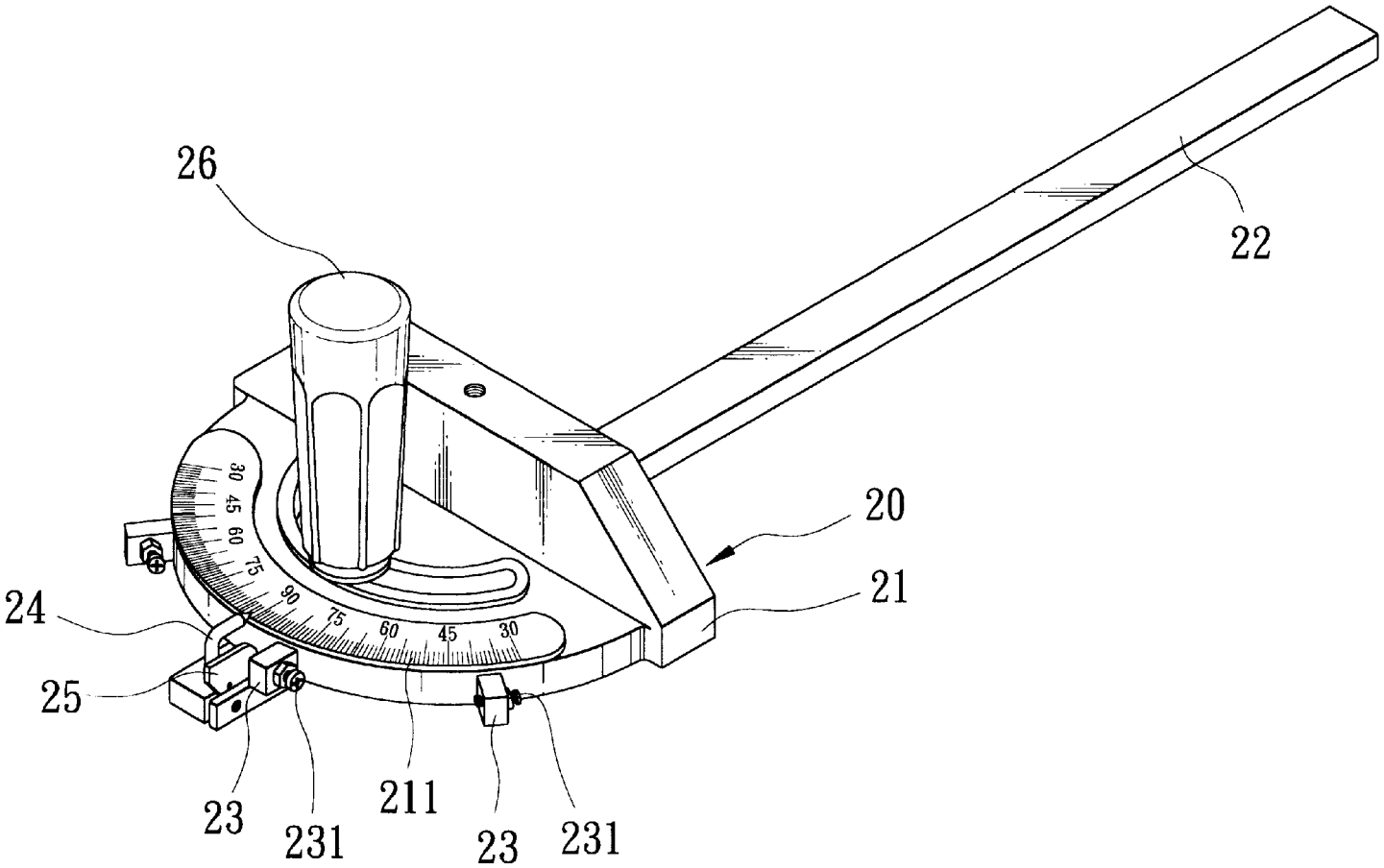
FIG. 2 PRIOR ART
FIG. 2 is an assembled perspective view of another conventional angle indicating apparatus capable of positioning at predetermined angles.
Figure 3:
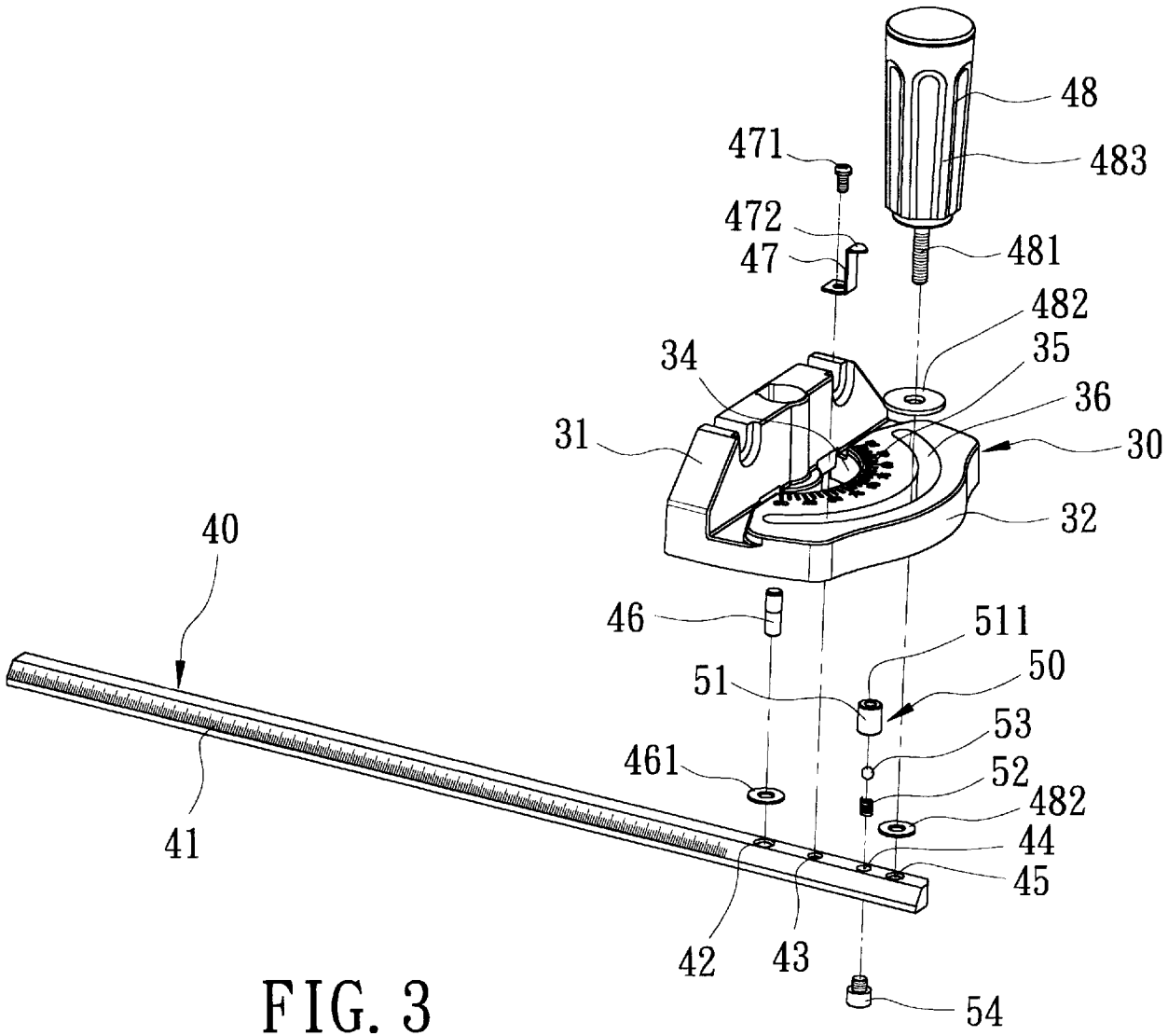
FIG. 3 is an exploded perspective view of a preferred embodiment of an angle indicating apparatus according to the present invention.
Figure 4:
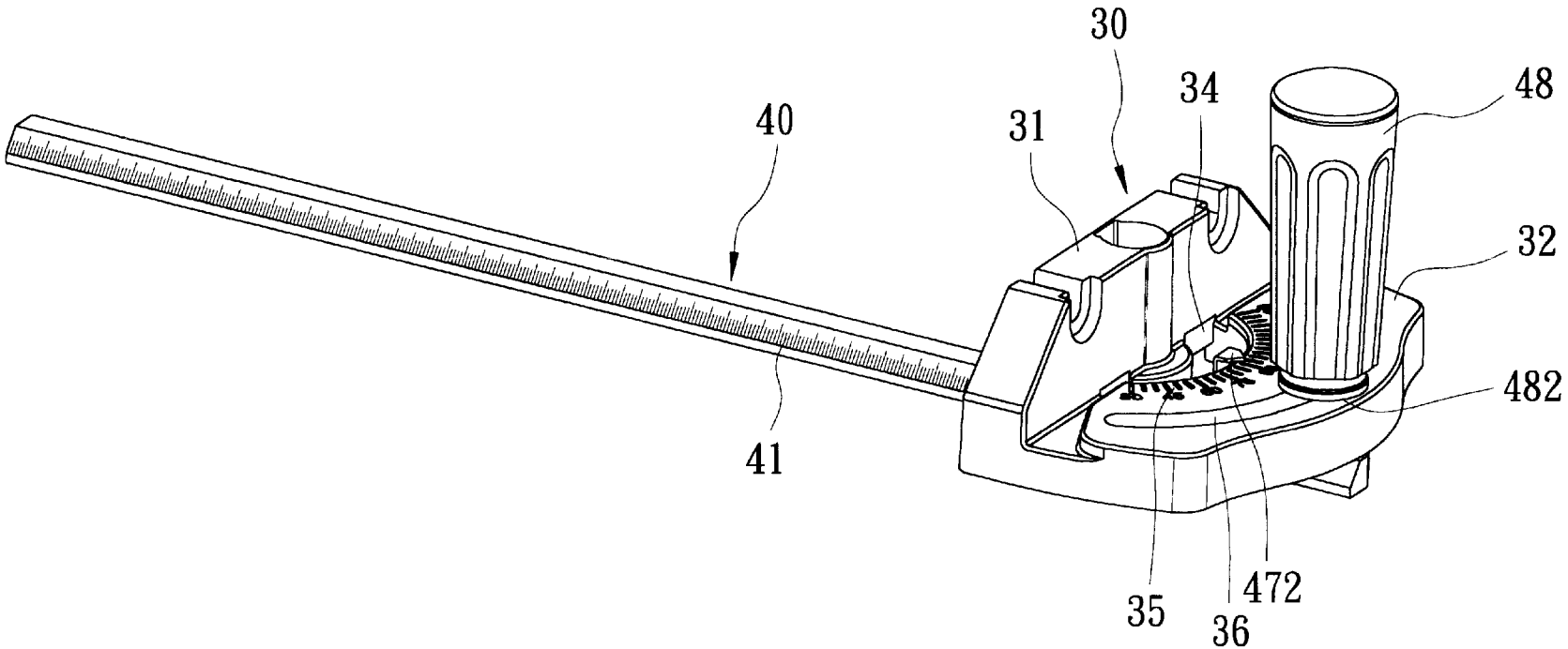
FIG. 4 is an assembled perspective view of the preferred embodiment.
Figure 5:
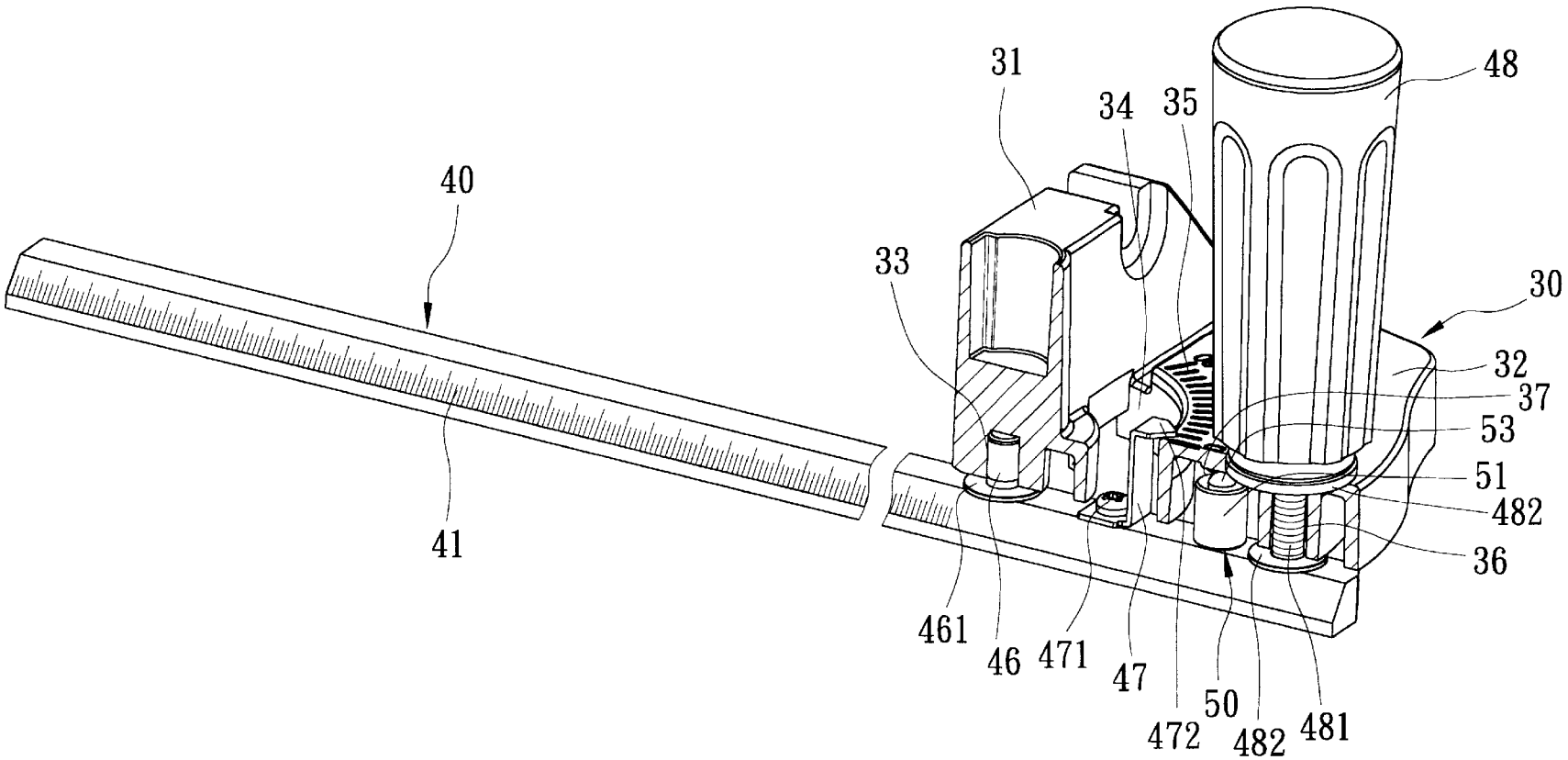
FIG. 5 is a partly cutaway assembled perspective view of the preferred embodiment.
Figure 6:
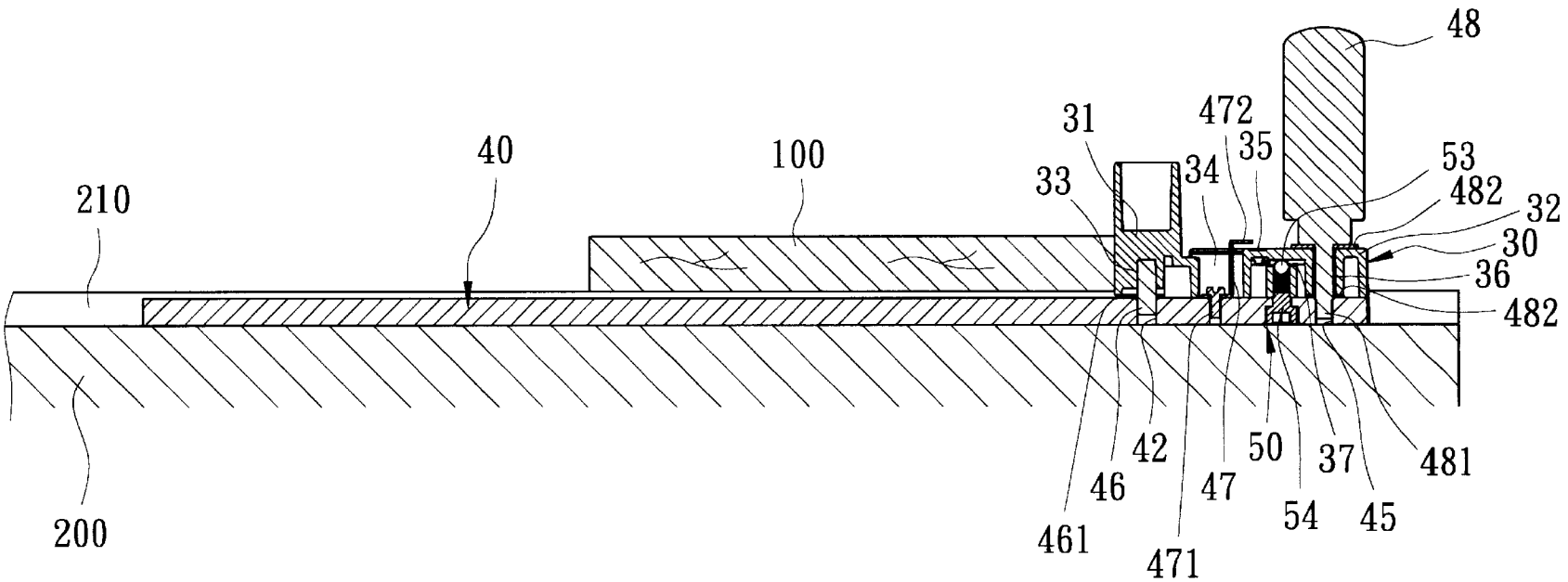
FIG. 6 is an assembled sectional view of the preferred embodiment.

Referring to FIGS. 3 to 6, the preferred embodiment of an angle indicating apparatus according to this invention is shown to include a rod member 40, an indicia member 30, an indicator 47, a spring-loaded tumbler unit 50, and a locking unit 48.

The rod member 40 is adapted to be slidably received in a slide groove 210 of a table saw 200 (see FIG. 6) in a known manner such that the angle indicating apparatus can be positioned on and is slidable relative to the table saw 200. In this embodiment, the rod member 40 is formed as a ruler body having length indicia 41 provided therealong for measuring a work piece 100 (see FIG. 6) to be cut by the table saw 200. The rod member 40 is formed with a pivot hole 42, an indicator mounting hole 43, a tumbler mounting hole 44 and an internally threaded hole 45 in sequence therealong.

Figure 7:
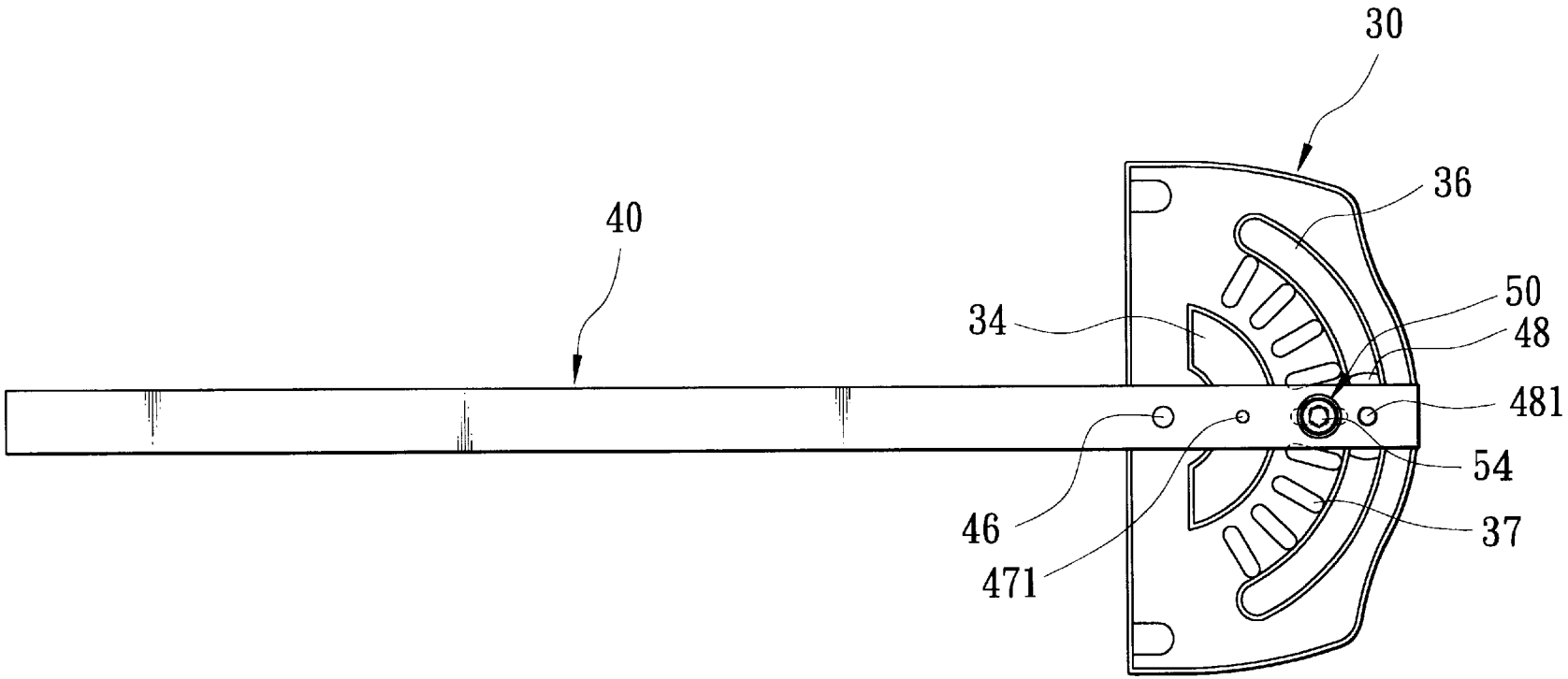
FIG. 7 is a schematic bottom view of the preferred embodiment.

The indicia member 30 includes a base plate 32 and a stop block 31 extending uprightly from one end of the base plate 32. The stop block 31 is used to abut against the work piece 100, and has a bottom side formed with a pin hole 33 at the center thereof. The indicia member 30 is mounted pivotally on the rod member 40 about a pivot axis via a pivot pin 46 that engages the pin hole 33 and the pivot hole 42. A washer 461 is sleeved on the pivot pin 46 and is disposed between the indicia member 30 and the rod member 40. The base plate 32 is formed with a generally semi-circular cutout 34 having a straight edge that is proximate to the stop block 31, and a curved edge that is connected to the straight edge and that has a curvature centered at the pivot axis. The base plate 32 has a top side provided with angle indicia 35 that are disposed adjacent to the curved edge of the cutout 34. The base plate 32 is further formed with a curved guide slot 36 that is disposed radially and outwardly of the curved edge of the cutout 34 with respect to the pivot axis. The base plate 32 further has a bottom side disposed on top of the rod member 40 and formed with a plurality of angularly spaced apart positioning grooves 37, as best shown in FIG. 7. Each of the positioning grooves 37 has a generally V-shaped cross-section. The positioning grooves 37 correspond respectively to predetermined angles and are spaced apart at equal radial distances from the pivot axis. In this embodiment, adjacent ones of the positioning grooves are spaced apart by a 15-degree angle relative to the pivot axis, and the predetermined angles are 30, 45, 60, 75 and 90 degrees.

The indicator 47 is mounted at the indicator mounting hole 43 in the rod member 40 via a screw fastener 471, is disposed in the cutout 34, and has a pointing end 472 pointing to the angle indicia 35.

Figure 8:
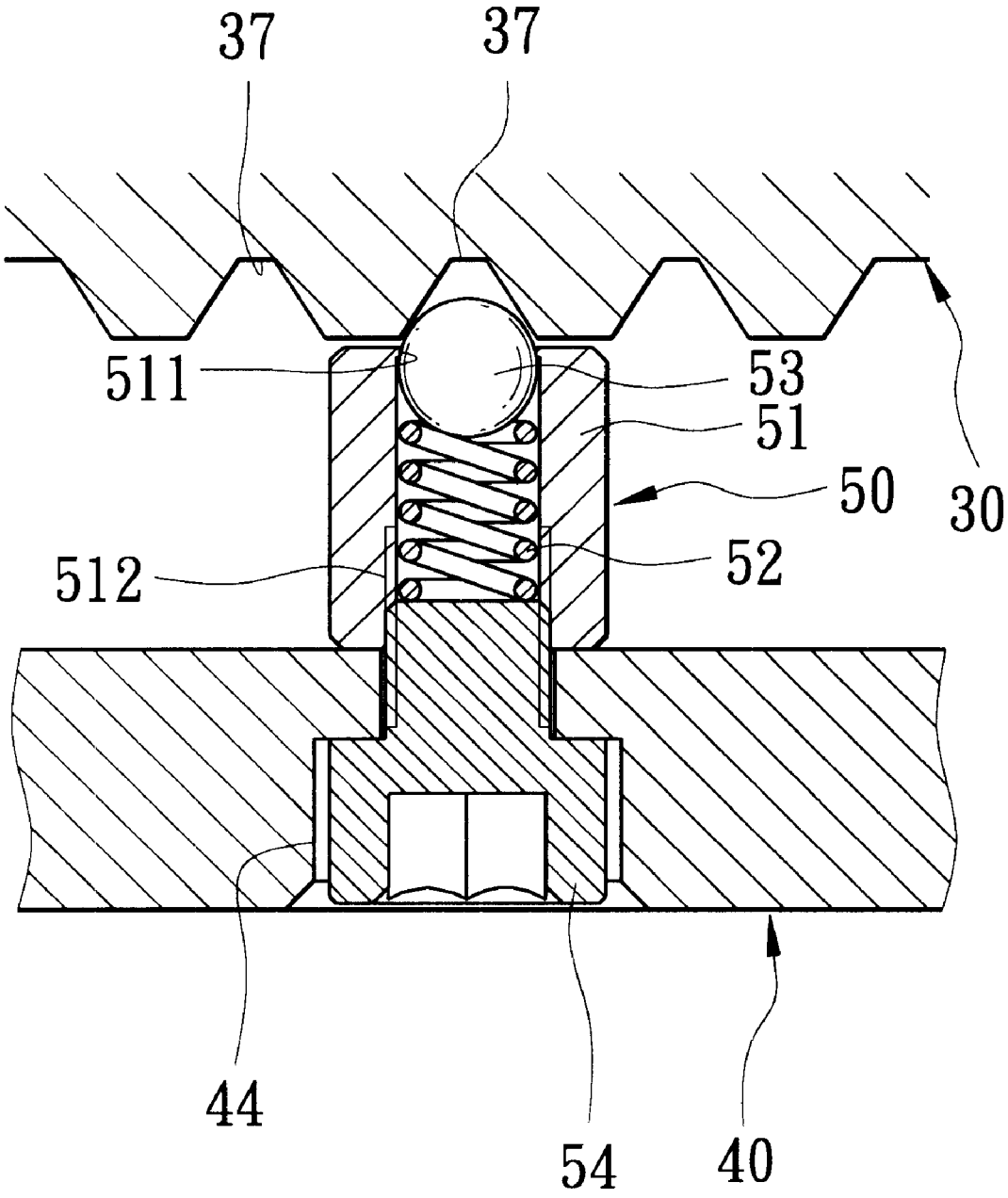
FIG. 8 is a fragmentary schematic sectional view illustrating engagement between a spring-loaded tumbler unit and one of the positioning grooves in the bottom side of an indicia member of the preferred embodiment.

With further reference to FIG. 8, the spring-loaded tumbler unit 50 is shown to include a tubular post 51 having an upper end formed with a restricted opening 511 and an internally threaded lower end 512 opposite to the upper end and mounted at the tumbler mounting hole 44 in the rod member 40 via a screw fastener 54, a spring 52 disposed in the tubular post 51, and a ball 53 disposed in the tubular post 51 and biased by the spring 52 to project out of the restricted opening 511 and engage removably a selected one of the positioning grooves 37 in the bottom side of the base plate 32.

The locking unit 48 includes a handle body 483 and a threaded shank 481 extending from the handle body 483 and through the guide slot 36 so as to threadedly engage the rod member 40 at the internally threaded hole 45, thereby arresting undesired rotation of the indicia member 30 relative to the rod member 40. The locking unit 48 further includes a pair of washers 482 sleeved on the threaded shank 481 and disposed above and below the indicia member 30.

Figure 9:
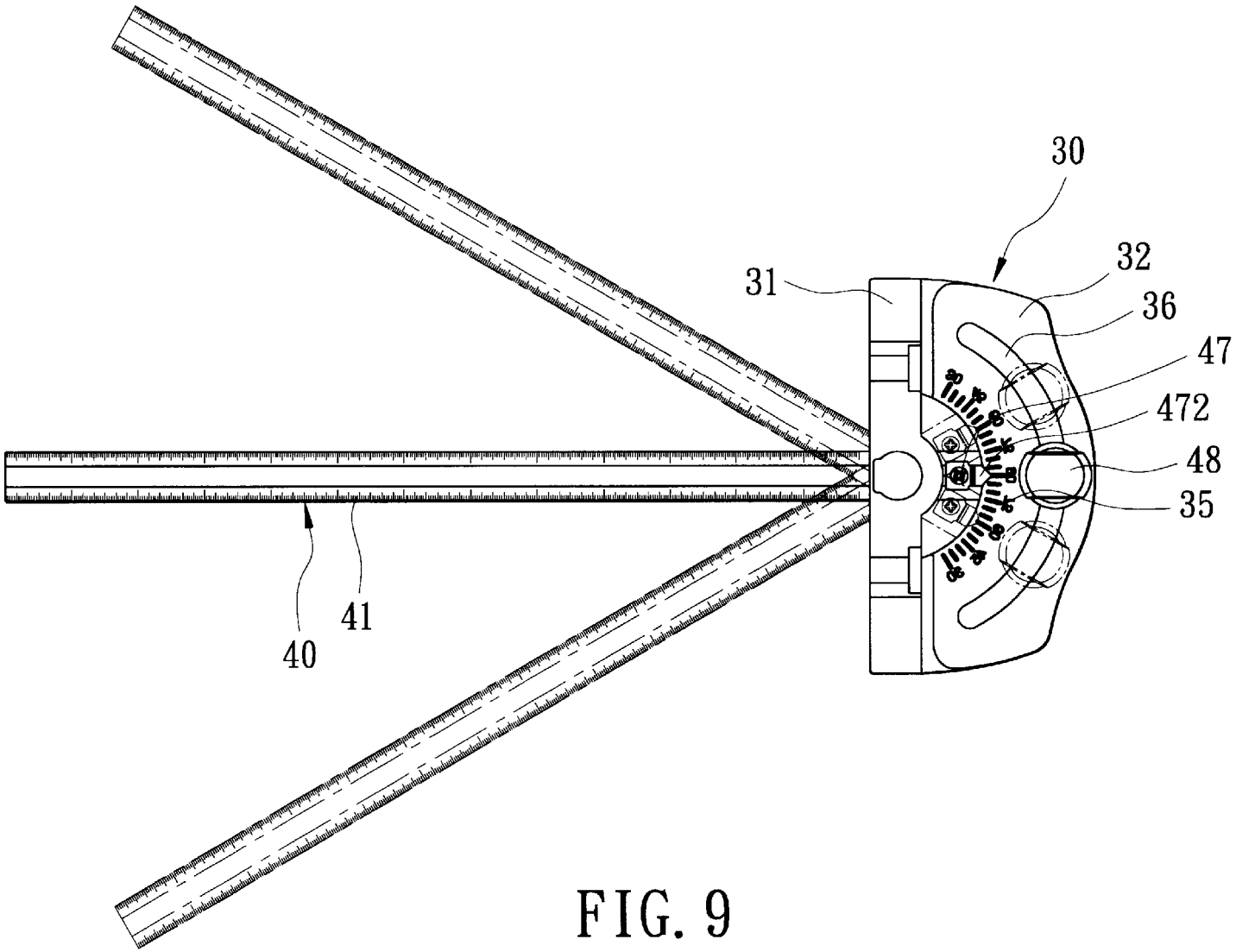
FIG. 9 is a schematic top view to illustrate positioning of the preferred embodiment at predetermined angles.

Referring further to FIG. 9, for quick positioning of the angle indicating apparatus of this invention at any of the predetermined angles, the locking unit 48 is first operated such that the indicia member 30 is pivotable about the pivot axis relative to the rod member 40. Thereafter, the indicia member 30 is rotated to the desired one of the predetermined angles as indicated by the indicator 47, which points to the angle indicia 35. By virtue of releasable engagement between the positioning grooves 37 of the indicia member 30 and the tumbler unit 50, positioning is possible at the desired one of the predetermined angles. Finally, the locking unit 48 is operated to retain the indicia member 30 at the desired one of the predetermined angles.

The following are some of the advantages of the angle indicating apparatus of the present invention: The number of positioning grooves and predetermined angles can be larger. The angle and length indicia are convenient to read and safe to use. The angle-adjusting operation is quick and easy to conduct. No periodic adjustment of components is needed. In addition, highly accurate angle positioning is possible.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. An angle indicating apparatus capable of positioning at predetermined angles, comprising:

a rod member;

an indicia member mounted pivotally on said rod member about a pivot axis, said indicia member including a base plate and a stop block extending uprightly from one end of said base plate, said base plate being formed with a generally semi-circular cutout, said cutout having a straight edge that is proximate to said one end of said base plate, and a curved edge that is connected to said straight edge and that has a curvature centered at said pivot axis, said base plate having a top side provided with angle indicia that are disposed adjacent to said curved edge of said cutout, said base plate being further formed with a curved guide slot that is disposed radially and outwardly of said curved edge of said cutout with respect to said pivot axis, said base plate further having a bottom side disposed on top of said rod member and formed with a plurality of angularly spaced apart positioning grooves, said positioning grooves corresponding respectively to the predetermined angles and being spaced apart at equal radial distances from said pivot axis;

an indicator mounted on said rod member and disposed in said cutout, said indicator having a pointing end pointing to said angle indicia;

a spring-loaded tumbler unit mounted on said rod member for engaging removably a selected one of said positioning grooves in said bottom side of said base plate; and a locking unit that passes through said guide slot and that is operable so as to engage said rod member in order to arrest undesired rotation of said indicia member relative to said rod member.

2. The angle indicating apparatus as claimed in claim 1, wherein each of said positioning grooves has a generally V-shaped cross-section.

3. The angle indicating apparatus as claimed in claim 1, wherein adjacent ones of said positioning grooves are spaced apart by a 15 angle relative to said pivot axis.

4. The angle indicating apparatus as claimed in claim 1, wherein said tumbler unit includes a tubular post having a lower end mounted on said rod member and an upper end formed with a restricted opening, a spring disposed in said tubular post, and a ball disposed in said tubular post and biased by said spring to project out of said restricted opening to engage the selected one of said positioning grooves.

5. The angle indicating apparatus as claimed in claim 4, wherein said rod member is provided with a screw fastener to threadedly engage said lower end of said tubular post.

6. The angle indicating apparatus as claimed in claim 1, wherein said rod member is formed as a ruler body having length indicia provided therealong.

7. The angle indicating apparatus as claimed in claim 1, wherein said locking unit includes a handle body and a threaded shank extending from said handle body and through said guide slot so as to threadedly engage said rod member.

* * * * *